US005203755A

United States Patent [19]

Kaiser

[11] Patent Number: 5,203,755

[45] Date of Patent: Apr. 20, 1993

[54] EXERCISE APPARATUS FOR INVERTING A HUMAN BODY

[76] Inventor: William D. Kaiser, P.O. Box 849, Santa Margarita, Calif. 93453

[21] Appl. No.: 828,210

[22] Filed: Jan. 30, 1992

[51] Int. Cl.[5] ..... A63B 26/00

[52] U.S. Cl. ..... 482/144; 482/142

[58] Field of Search ..... 482/141, 142, 143, 144, 482/70, 95, 96, 140

[56] References Cited

U.S. PATENT DOCUMENTS

| | | | |
|---|---|---|---|
| 4,444,178 | 4/1984 | Kuo | 482/144 |
| 4,494,533 | 1/1985 | Sgroi et al. | 482/144 |
| 4,566,693 | 1/1986 | Seidentop et al. | 482/144 |
| 5,135,459 | 8/1992 | Perry, Jr. | 482/144 |

FOREIGN PATENT DOCUMENTS

| | | | |
|---|---|---|---|
| 8803825 | 6/1988 | World Int. Prop. O. | 482/140 |

OTHER PUBLICATIONS

NordicTrack Brochure (8 pages), NordicTrack, 124 Columbia Court, Chaska, Minn. 55318; 1984.

*Primary Examiner*—Stephen R. Crow
*Attorney, Agent, or Firm*—Daniel C. McKown

[57] ABSTRACT

In an exercise apparatus of the type in which a user is suspended in an inverted position for the purpose applying traction to his spinal column and for the purpose of performing strengthening exercises such as abdominal rotations and oblique curls, the user is provided with an unrestricted exercise space by mounting the conventional pivotable pelvic cushion and knee cushion assembly at the upper end of a single forwardly inclined post so that obstructing structure members are not used.

7 Claims, 2 Drawing Sheets

EXERCISE APPARATUS FOR INVERTING A HUMAN BODY

BACKGROUND OF THE INVENTION

1. Field of the Invention

The present invention is in the field of exercise apparatus and specifically relates to an improvement in apparatus for inverting a human body for the purpose of producing gravity traction and for facilitating certain types of exercises.

2. The Prior Art

A search of the prior art reveals that a number of inverting back exercisers have been patented. They include U.S. Pat. No. 4,546,972 issued Oct. 15, 1985 to Goyer; U.S. Pat. No. 4,503,845 issued Mar. 12, 1985 to Licciardi; U.S. Pat. No. 4,438,761 issued Mar. 27, 1984 to McGowen; U.S. Pat. No. 4,534,555 issued Aug. 13, 1985 to McGowen; U.S. Pat. No. 4,566,693 issued Jan. 28, 1986 to Seidentop, et al.; U.S. Pat. No. 4,609,193 issued Sep. 2, 1986 to Paris, et al.; U.S. Pat. No. 4,753,438 issued Jun. 28, 1988 to Paris, et al.; and U.S. Pat. No. 4,893,813 issued Jan. 16, 1990 to Murray, et al.

Curiously, when viewed in a side elevational aspect, all of these patents show an A-frame base that supports a fulcrum on which a body-contacting member pivots through a limited angle.

The purpose of these prior art devices is to enable the user to maintain himself in an inverted position, that is, with his head near the floor between the sides of the A-frames. While in the inverted position, the user may perform certain exercises.

Unfortunately, the sloping legs of the A-frames limit how far the user can twist from side to side and how far he can extend his arms or elbows. This limitation has a tendency to make the user cautious not to move his body to the maximum extent for fear of colliding with the sloping side of the A-frame. This inhibiting effect prevents many users from developing their bodies to the maximum extent.

As will be seen below, the structure of the present invention allows greater freedom of motion to the user, thereby permitting him to obtain the full benefit of the apparatus.

SUMMARY OF THE INVENTION

In accordance with the present invention, the fulcrum of the exercising apparatus is supported by a single post that extends upwardly and slightly forwardly from a base, thereby eliminating certain structural members used in prior art apparatus that had a tendency to restrict and confine the user's movements.

In prior art devises, the forward leg of the A-frame support for the fulcrum necessarily extended into the space used for exercising. Since there is no corresponding member in the present invention, the user may go about performing his exercises without being inhibited by the possibility of bumping into a structural member.

The novel features which are believed to be characteristic of the invention, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
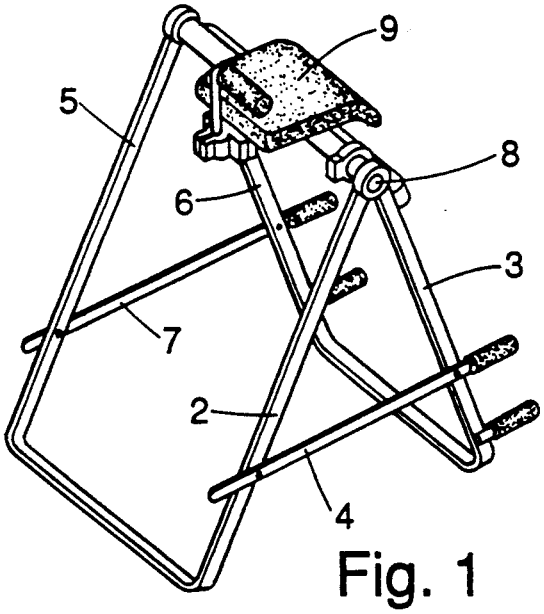
Fig. 1 PRIOR ART
FIG. 1 is a perspective view showing a typical exercise apparatus of the prior art.

FIG. 1 shows a typical exercise apparatus of the prior art. The members 2, 3 and 4 form an A-frame and the members 5, 6, and 7 form a second A-frame. These two A-frames support a fulcrum 8 with its axis horizontal. The cushion assembly 9 pivots about the fulcrum 8. Most of the exercises are performed in the space between the members 3 and 6, and typically the spacing between those members is on the order of 24 inches. When certain exercises such as the abdominal rotation and the oblique curl are performed, the user must be careful not to bump his elbow or arms against the members 3 and 6.

The A-frame design of the prior art exercise apparatus shown in FIG. 1 is widely used because the legs 2 and 3 as well as the legs 5 and 6, respectively, can be brought together for minimizing the storage space required. However, the disadvantage of the A-frame is the typically limited space between the members 3 and 6 which requires the user to be alert and conscious of the presence of these members so that he can avoid them when doing certain exercises.

The present invention makes use of a different design for the structure that supports the fulcrum. As will be seen below, the support structure of the present invention avoids the crowding that is inherent in the A-frame structure.

Figure 3:
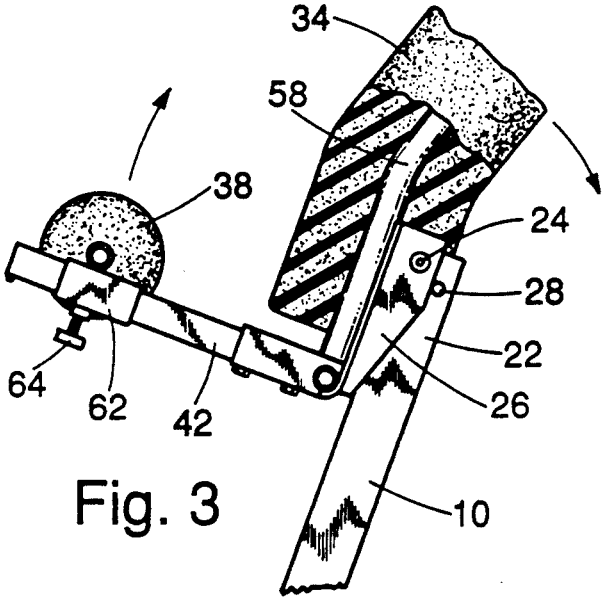
FIG. 3 is a fractional side elevational view in the direction 3—3 indicated in FIG. 2.
Figure 2:
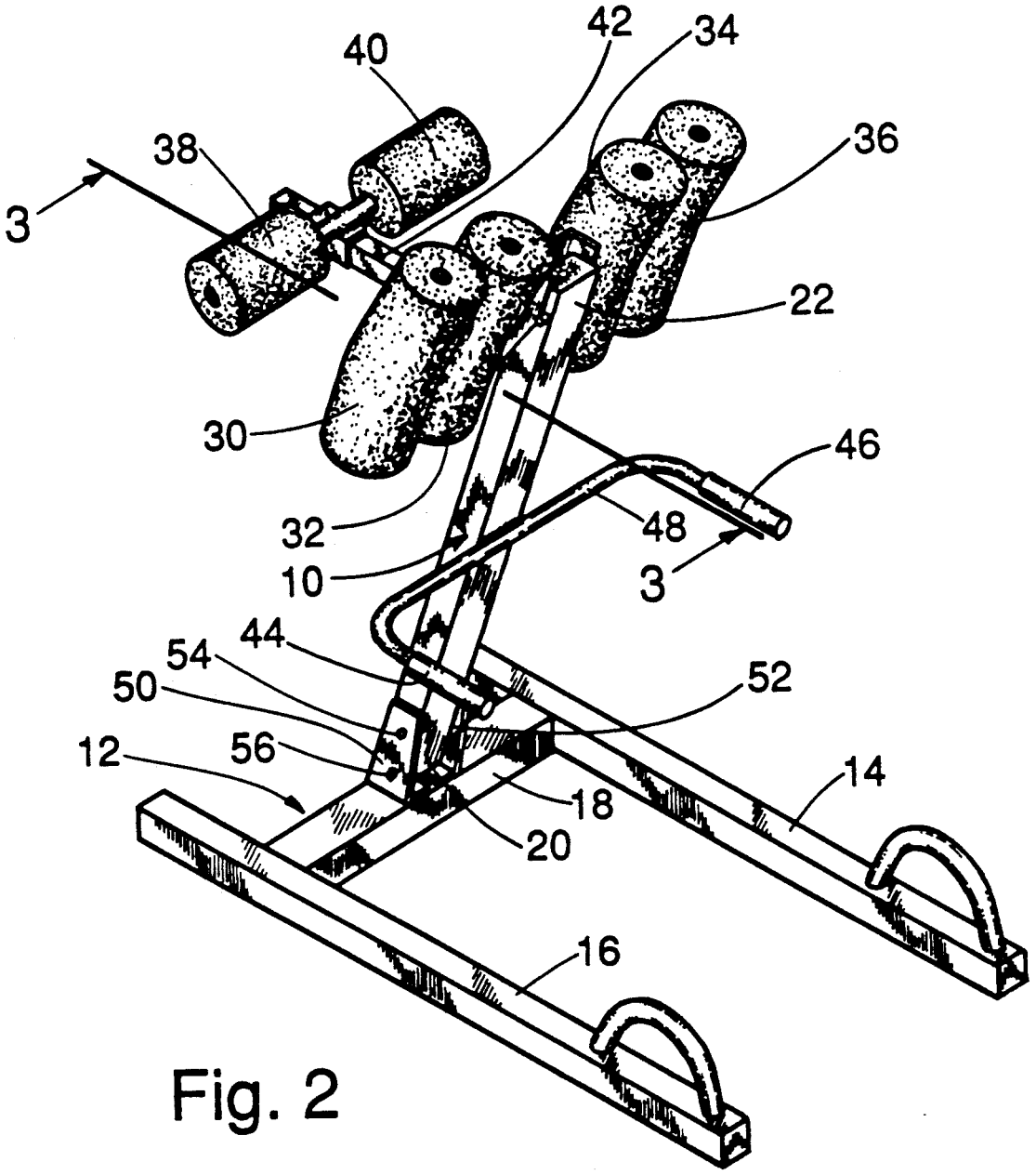
FIG. 2 is a perspective view of the preferred embodiment of an exercise apparatus of the present invention.

Turning now to FIGS. 2 and 3, it is seen that the present invention includes a post 10 that extends upwardly and slightly forwardly from the base 12. The base 12 consists of two parallel spaced longitudinal members 14 and 16 that are interconnected by a lateral structural member 18 from which the post 10 extends and to which the lower end 20 of the post is connected.

Two L-shaped brackets 50 and 52 that are welded to the lateral member 18 form a yoke within which the post 10 can pivot about the pin 54 when the pin 56 has been removed. This permits the post 10 to be pivoted down to an approximately horizontal position for ease of shipping and storage, but the pins 54 and 56 are always inserted when the apparatus is in use.

As best seen in FIG. 3, the frame 26 of the cushion assembly is pivotally attached to the upper end 22 of the post 10 by means of the pin 24. The extent of the movement in the counterclockwise direction is limited by the pin 28.

Pelvic cushions 30, 32, 34 and 36 are attached to the frame 26 by a fork-like structure of metal tubing; the four tines of the fork extend within the four cushions as exemplified by the tine 58 of FIG. 3. The cushions 32 and 34 are spaced laterally to avoid excessive pressure on the user's groin. This was a problem with certain prior art machines, but the problem is overcome by the arrangement used in the present invention.

Knee cushions 38 and 40 are adjustably mounted on an arm 42 of square cross section by a sleeve 62 of square cross section and screw 64. It is extremely important that the knee cushions 38 and 40 should not rotate about the arm 42 when the apparatus is in use, as sometimes happened with prior art machines. In the present invention, such undesired rotation is absolutely prevented by the square cross section of the arm 42.

In using the exercise machine of the present invention, the user straddles the arm 42 of FIG. 3 in a standing position so that the knee cushions 38 and 40 are behind the user's thighs while the pelvic cushions 30, 32, 34 and 36 are in front of the user's pelvis. While still standing, the user bends forward and downward transferring his weight to the pelvic cushions which rotate clockwise as seen in FIG. 3. The user flexes his knees so that his legs extend partly around the knee cushions 38 and 40 as shown in FIGS. 4 and 5, to keep his body from sliding forward onto the floor.

Figure 5:
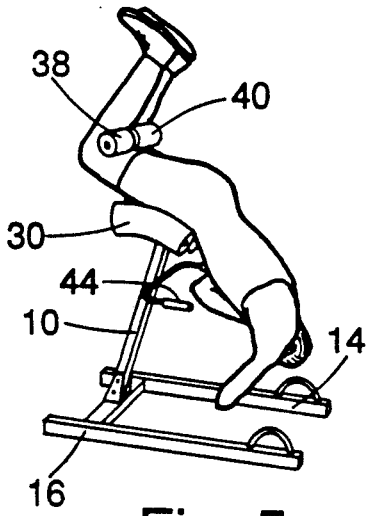
Figure 4:
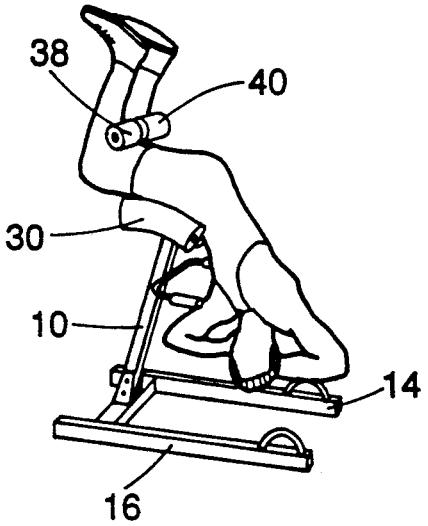
FIG. 4 is a side elevational view showing the exercise apparatus of the present invention being used for performing an abdominal rotation; and, FIG. 5 is a side elevational view showing the exercise apparatus of the present invention being used for performing an oblique curl.

With the user in this inverted position, a number of exercises are possible, including without limitation the abdominal rotation exercise illustrated in FIG. 4 and the oblique curl shown in FIG. 5.

In the abdominal rotation exercise of FIG. 4, the upper torso is rotated with respect to the pelvis. In the oblique curl of FIG. 5, the upper torso is moved from side to side with respect to the pelvis.

During these exercises, the hands are clasped behind the user's head so that the elbows extend sideways from the body as the user twists and turns while doing the exercises illustrated in FIGS. 4 and 5. It is highly desirable that the user should not have to worry about whether his elbows will strike parts of the equipment.

In the apparatus of the prior art shown in FIG. 1, the user had to be careful that his elbows did not strike the frame members 3 and 6. This apprehension has been relieved in the present invention by supporting the pelvic cushions at the end of a single forward-leaning post as seen in FIGS. 4 and 5.

The apparatus of the present invention includes a pair 44 and 46 of hand grips that are connected to the post 10 by handlebars 48. The hand grips 44 and 46 are useful to inexperienced users as they revolve into the inverted position. The hand grips 44 and 46 do not interfere with the user because the forward slope of the pot 10 keeps the hand grips 44, 46 in a position directly below the pelvic cushions. In contrast, in the apparatus of the prior art shown in FIG. 1, the frame members 3 and 6 slope downwardly and forwardly, and this results in the hand grips being a substantial distance forward of the cushion assembly 9.

Thus, there has been described an apparatus for performing exercises in an inverted position without fear of colliding with parts of the apparatus. In accordance with the present invention, this is accomplished by supporting the fulcrum and pelvic cushions on a single post that extends vertically and is inclined slightly forwardly. This gives the user an unconfined space in which to perform his exercises. Because he need not be apprehensive about striking the apparatus with his body, the user can perform the exercises with greater confidence and freedom.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An exercise apparatus for inverting a human body comprising in combination:

a base having a front portion and a rear portion;

a single post having a lower end connected to the rear portion of said base, said single post extending upwardly and forwardly above said base and having an upper end;

a pivotable assembly including a pelvic cushion, a knee cushion, and an arm holding said knee cushion in a constant spaced relationship to said pelvic cushion; and, means for mounting said pivotable assembly to the upper end of said single post for limited pivotal motion about a horizontal axis.

2. The exercise apparatus of claim 1 wherein said base further includes two spaced members extending from front to rear and a cross member extending laterally and connecting said two spaced members, and wherein said single post is connected to said cross member.

3. The exercise apparatus of claim 2 wherein said cross member further includes a yoke and a pin that extends through the lower end of said single post to pivotablly connect said single post to said base.

4. The exercise apparatus of claim 1 wherein said single post is inclined forwardly several degrees from vertical.

5. The exercise apparatus of claim 1 further including a sleeve selectively slidable on said arm for adjusting the separation of the knee cushion from the pelvic cushion.

6. The exercise apparatus of claim 1 wherein said pelvic cushion includes a central space between its right half and its left half to avoid excessive pelvic pressure.

7. The exercise apparatus of claim 1 wherein said arm has a rectangular cross section.

* * * * *